United States Patent [19]

Underwood et al.

[11] 4,092,495

[45] May 30, 1978

[54] SPEECH SYNTHESIZING APPARATUS

[75] Inventors: Michael John Underwood, Hitchin; Michael Joseph Martin, Stevenage; Michael Victor Iles, Loughton, all of England

[73] Assignee: International Computers Limited, London, England

[21] Appl. No.: 749,748

[22] Filed: Dec. 13, 1976

[30] Foreign Application Priority Data

Dec. 19, 1975 United Kingdom ..... 52016/75

[51] Int. Cl.[2] ..... G10L 1/00

[52] U.S. Cl. ..... 179/1 SM

[58] Field of Search ..... 179/1 SA, 1 SE, 1 SG, 179/1 SM

[56] References Cited

U.S. PATENT DOCUMENTS

| | | | |
|---|---|---|---|
| 3,102,165 | 8/1963 | Clapper | 179/1 SG |
| 3,703,609 | 11/1972 | Gluth | 179/1 SA |
| 3,746,791 | 7/1973 | Wolf | 179/1 SA |
| 3,828,132 | 8/1974 | Flanagan | 179/1 SA |
| 3,830,977 | 8/1974 | Deschaux | 179/1 SA |
| 3,908,085 | 9/1975 | Gagnon | 179/1 SG |

*Primary Examiner*—Kathleen H. Claffy
*Assistant Examiner*—E. S. Kemeny
*Attorney, Agent, or Firm*—Hane, Roberts, Spiecens & Cohen

[57] ABSTRACT

Speech synthesizing apparatus is provided in which different sounds are required for a plurality of channels. The channels are polled in turn on a cyclic scanning basis, the scan for each channel occupying a channel sampling period during which an instantaneous value is generated for the amplitude of a voiced sound component. Values representing instantaneous amplitudes of each of a plurality of unvoiced sounds are separately generated in turn during the period occupied by the scanning of all the channels and these values are stored. A selected one of the unvoiced sound values is extracted from the store as required for a particular channel during the sampling period for that channel, so that an updated value for the unvoiced sound is available on each occasion that that particular channel is sampled. The voiced and unvoiced sound values are then combined during the appropriate sampling periods. The required sound combinations are specified by parameters expressed in digital form for each channel separately.

6 Claims, 7 Drawing Figures

7
RELATIVE AMP - A2
RELATIVE AMP - A3
RELATIVE AMP - AF
A2
A3
AF
A00
PP
103
104
105
A07/11
A12/16
A17/30
106
108
109
SCALING SELECTION NETWORK
107
A04
A09
A14
A18
MULTIPLEXER SHIFTING NETWORK
102
A17/30
90
36
OR
101
110
114
115
116
117
118
119
144
A05
A10
A15
A19
A25
ST11
ST10
ST01
113
111
ACCUMULATOR REG
112
A23

SPEECH SYNTHESIZING APPARATUS

CROSS REFERENCE TO RELATED APPLICATION

Application Ser. No. 749768, filed on Dec. 13, 1976 by the present inventors and assigned to the same Assignee is concerned with the production of voiced sound components which are to be combined with unvoiced sound components as described and claimed herein.

BACKGROUND OF THE INVENTION

1. Field of the Invention

The present invention relates to apparatus for synthesizing human speech by the generation and combination of representations of speech components.

2. Description of the Prior Art

It has previously been proposed to synthesize human speech by the generation of sounds and the combination of a plurality of such generated sounds to represent basic speech parts. Some thought has also been given, in the prior art, to the stringing together of a number of such basic parts to simulate words or phrases. The basic sound parts have been referred to as phonemes and it has been found possible to analyse the phonemes required for intelligible speech and to specify the requirements of such phonemes in terms of sound characteristics that each requires for its reproduction.

Thus, for example, two major kinds of sound have been identified; namely, voiced sounds which are primarily the result of vibration of the vocal chords resonating in the cavities that are formed, for example, by the tongue acting in the mouth, and unvoiced sounds which are typically the sibilants and which tend to be basically derived from a random sound source such as white noise. In the case of the voiced sounds it has also been found that although in analysing the waveform of such sounds, several components of different frequencies can be identified, nevertheless a combination of only three waves of different respective frequencies is sufficient to produce a waveform that produces a recognisable sound. Thus, in typical apparatus as previously proposed, three sine-wave generators of differing frequencies have been used to provide the three basic waveforms and these have been referred to as the three formants of the sound. The formant waveforms are damped and combined to produce a resultant waveform, the relative amplitudes of the individual formant waveforms being varied to modify or give recognisable character to the resultant sound.

In such prior apparatus unvoiced sound has been derived from a white noise generator, the sound from which has been filtered and added to the combination of the basic formants. Finally, the combination has been filtered and subjected to attenuation according to specifiable laws to produce the final signal for application to a sound-reproducing transducer such as a loudspeaker. It will be seen therefore that essentially in such prior proposals the sound components are generated continuously and the controls imposed on the resultant sound elements are, in principle, all related to proportioning the amplitudes of the components required, such proportioning also involving, where appropriate, the inhibition of one or more elements, and of applying some form of attenuation or damping after the combination has been effected.

Because of the essentially continuous and analogue nature of these previously-known methods of speech synthesis it will be appreciated that there are difficulties in multiplexing synthesized speech over a plurality of channels each requiring different expressions. Thus, for example, in a typical arrangement one channel would be required to wait for the completion of a "spoken" phrase on another channel before it could acquire the use of the synthesizer for its own phase.

SUMMARY OF THE INVENTION

The present invention proposes a method of sound generation based on digital specification of sound parameters for use in speech synthesis that will permit more readily the specification of different types of unvoiced sound components and the apparent concurrent generation of speech sounds on a plurality of channels.

According to the present invention, speech synthesizing apparatus includes means for generating a voiced sound representation; means for generating an unvoiced sound representation; means for combining sound representations; means for modifying the amplitude of a sound representation; means for registering parameters of a required sound and control means responsive to the registered parameters to control selective application of sound representations to the combining and modifying means.

The apparatus may use a multiplying means for modifying the sound representation and may use summing means to combine the value representations. The selection of the multiplying and summing means to modify the values may be performed by using a plurality of gates controlled by timing signals to determine, for example, the order in which values are modified to permit combination of values before or after one of them, say, has been modified. For serving a plurality of channels, the unvoiced sound value (or values if several unvoiced sound components are provided) is preferably updated independently of the cyclic selection of channels. The updating taking place for any particular value between its selection on successive channel cycles.

DESCRIPTION OF THE DRAWINGS

Apparatus embodying the present invention will now be described, by way of example; with reference to the accompanying drawings, in which.

DESCRIPTION OF THE PREFERRED EMBODIMENTS

Figure 1:
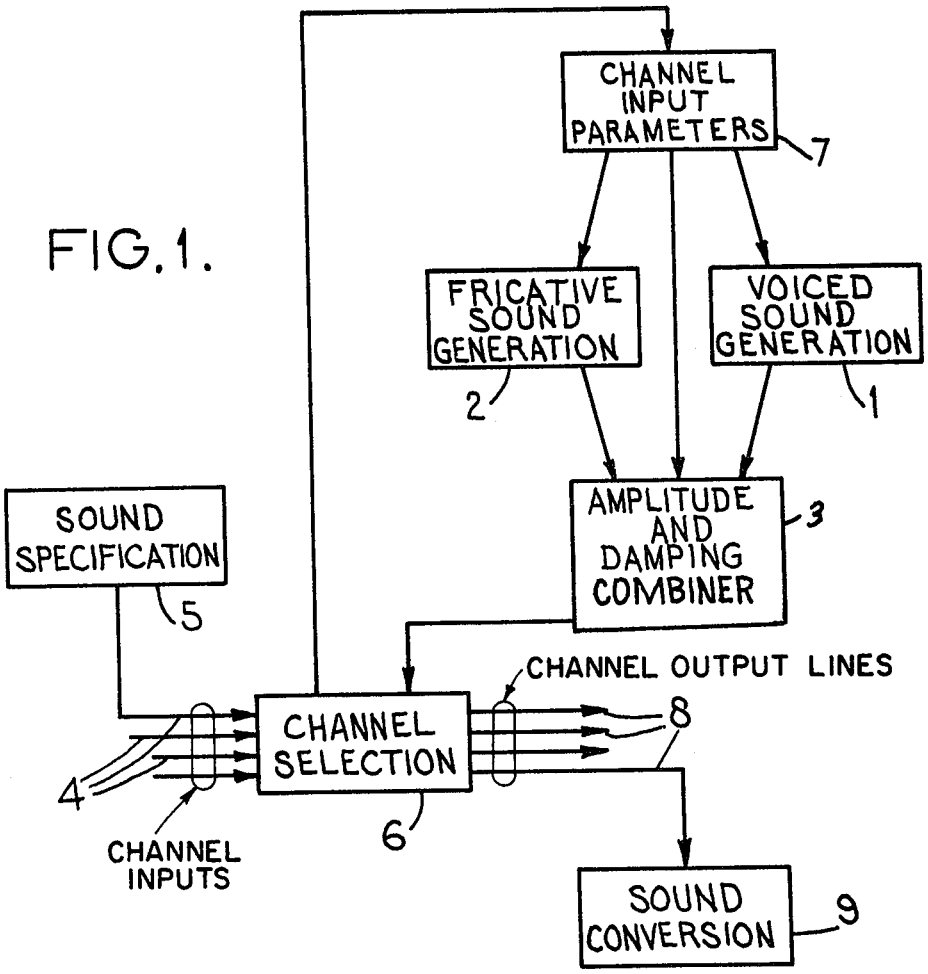
FIG. 1 is a block diagram showing the principle elements of a speech synthesising apparatus.

Referring now to FIG. 1 of the drawings a voice synthesizing arrangement consists of a voiced sound generating arrangement 1 and an unvoiced or fricative sound generating arrangement 2 together with an arrangement 3 for combining voiced and unvoiced components of a speech sound from the generators 1 and 2 respectively. Each speech sound to be generated is specified by input parameters which specify in digital terms its parameters, such as formant frequencies, sound quality or type, relative amplitudes of the sound components and the overall pitch and amplitude of the sound.

The arrangement is to be used for supplying synthesized speech to a plurality of channels and each channel is required to be associated with an input 4, each input 4 consisting of a group of lines. The channel inputs 4 each carry signals from an arrangement 5 which specifies and stores the parameters for the sound to be generated on that channel. As will be noted hereafter, the block 5 contains a group of registers which are set by a data processing apparatus which is associated with the respective channel and which specifies parameters of the sound to be synthesized. Although the data processor forms no part of the present invention, it would typically store parameters of speech sound sequences and load the registers of the block 5 progressively for each sound of a selected sequence. The provision of a number of channels enables several different sequences to be serviced concurrently by the cyclic scanning of the channels. A channel selecting arrangement 6 scans the channels on a cyclic basis and permits the parameters for each channel in turn to be entered into an input parameter storage block 7 to control the generation of the components required for the sound currently to be produced by the generators 1 and 2. The resultant combination from the arrangement 3 is passed to the channel selection arrangement 6 once more and appears on an output 8 associated with the selected channel. The outputs are in digital form and each channel has a conversion arrangement 9 associated with it to convert a sequence of digital values into an equivalent sound.

For the sake of simplicity, the operation of the various blocks described above will be described in turn in greater detail and it will be assumed initially that a single channel has been selected and that the parameters for the required sound have been entered into the parameter storage block 7.

Before considering the blocks in detail it will be realized that the operations within the blocks require to be synchronized. Because of the differing nature of the operations of generating voiced and unvoiced sounds the relative timings of, for example, operations within the blocks 1 and 2 will be briefly reviewed. The present arrangement is based on the requirement that each channel is to be sampled regularly on a cyclic basis once in every 100μs. Provision is made for sampling thirty-two channels so that a period of 3.125μs is available for generating a sample value for each channel.

However, as will be described in detail below, the generation of fricative values by the arrangement 2 requires more time than is available for generating the sample value for each individual channel, so the timing for the drive of the arrangement 2 is made independent of the individual channel sampling periods outlined above. Moreover, it will be seen that more than one fricative sound is to be provided by the fricative generator 2 and it is useful at this point briefly to review the purpose of sounds to be provided by this generator. In the present arrangement the fricative sounds generated are intended to simulate the unvoiced hiss-like sounds that occur in speech. Thus, a basic noise waveform is modified by the generator 2, for example, in one case to enhance higher frequencies, producing a sound line "s", as is "sins". Similarly lower frequencies are selectively enhanced in other instances to produce derivatives such as the sound "sh" as in "ship", or "f" as in "file", "h" as in "he" or "th" as in "thing". From these sound forms others may be produced, as by combination with a voiced component, such as "z" as in "zero"; the hard "sh" sound and the "v" as in "vision" or "th" as in "those". It is found that these five continuous fricatives alone are sufficient for intelligible speech forms in the English language, However, other languages are found to require additional or alternative unvoiced sounds. Examples of such additional sounds, even when considering only English, readily come to mind when considering geographical locations which occur in the United Kingdom and involve such sounds as the "ll" sound in the Welsh "Llanelli", or the "ch" sound as in Scottish "loch". As will be seen it is convenient, having regard to the timing available, to provide for eight different fricative sounds within the generator 2, which are found adequate to represent the fricative sounds required and the values for all of these possible sounds are to be updated once in each 100μs. The updated values are then buffered so that whatever fricative sound is required by a channel, an its updated value will be available in the buffer on each occasion that it is required by that channel. Thus, the driving requirements, for the fricative sound generating arrangement 2 are also based on a cycle period of 100μs. Since eight sounds are to be provided, then within this cycle, each individual sound updating period is 12.5μs.

Finally, various timing signals for gating and logic control purposes are required in the arrangements 1 and 3 and these signals are required to be synchronised to the channel sampling periods. It is convenient to derive the timing signals from a 32 stage shift register cycled once in each channel period, so that the driving frequency for the shift register is 10.24Hz corresponding to a timing signal period of 97.67ns. For convenience all the timing requirements described above are derived by frequency division from a 10.24MHz pulse source and it will be apparent that all parts of the apparatus are maintained in synchronism to the 100μs period which is common to both arrangements 2 and 3.

Figure 2:
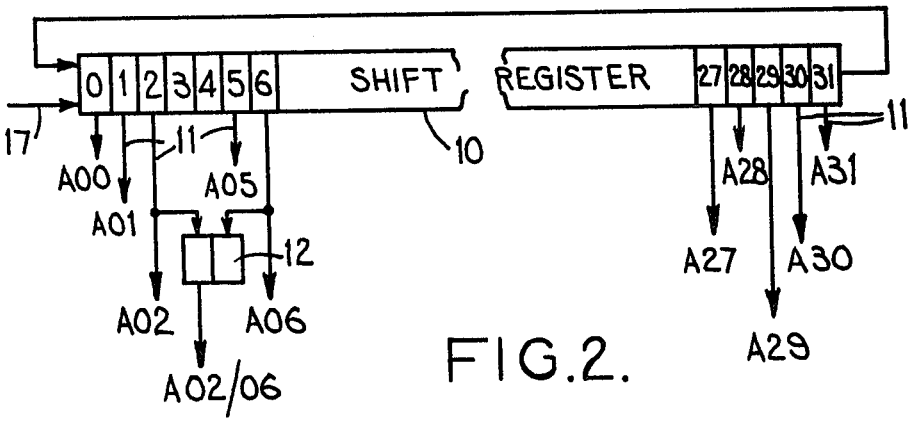
FIG. 2 shows a timing generator

Referring now to FIG. 2, this Figure shows, in simplified form, the way in which the logic and gating control timing signals are derived. A recirculating shift register 10 has 32 bistable stages one of which is in a set state while the remainder are unset. The application of shift pulses to the register 10 causes the set state to be transferred along the register from end to end in a series of repetitive cycles. Output lines 11 from the stages then carry signals in turn as the set state is moved along the register 10. Thus, for each cycle, an output signal from stage 0 of the register 10 will appear on a line A00, followed by an output on line A01 from stage 1 of the register, then by an output on line A02 from the stage 2, and so on. Some timing signals are required to have a duration greater than the time of occupation of one stage of the register and such signals may be generated, for example, by connecting a bistable, such as bistable 12, to be set by a signal on the output line 11 from one stage of the register and reset by the signal on the output line 11 from a leter stage. Thus, in the Figure, the bistable 12 is set by an output on the line A02 and reset by an output on the line A06 and a resultant output from the bistable 12 is available throughout the time that the bistable 12 remains set. The convention will be observed throughout the following description that timing signals from the timing generator will be given the references A00, A01 and so on, in dependence upon the particular stage of the shift register 10 from which they are derived. Where a timing signal is extended, as by a bistable such as the bistable 12 illustrated, the reference will indicate the duration of the signal by reference to the stages which initiate and terminate it. Thus, in the case of the bistable 12, the resultant signal is referred to as the signal A02/06.

The register 10 is stepped by a train of clock pulses derived from the source (not shown) referred to above at a frequency of 10.24 MHz. Because there are 32 stages in the register 10, a complete cycle of the register requires 3.125μs, which is the period for generating the sample vaue for a single channel. For convenience, this period will be referred to as the operational cycle of the apparatus.

CHANNEL INPUT PARAMETERS

A group of registers are provided for each channel and are contained within the block 5 of FIG. 1. For the sake of simplicity the block 5 is shown for one channel only, but it is to be understood that a block of registers 5 is provided for each channel. These registers are loaded with channel input data from the data processing apparatus respectively associated with the channel and contain binary coded representatives of values assigned to various parameters to specify the sound currently required for the channel. Each new sound is generated over a number of basic operating cycles allocated to that channel, the number of these cycles being determined by a value defining a pitch period, which will be explained hereinafter. At the beginning of a pitch period, therefore, the values from the block 5 are gated into the block 7, leaving the registers of block 5 available to receive the specification of the next sound required on the channel concerned.

Figure 3:
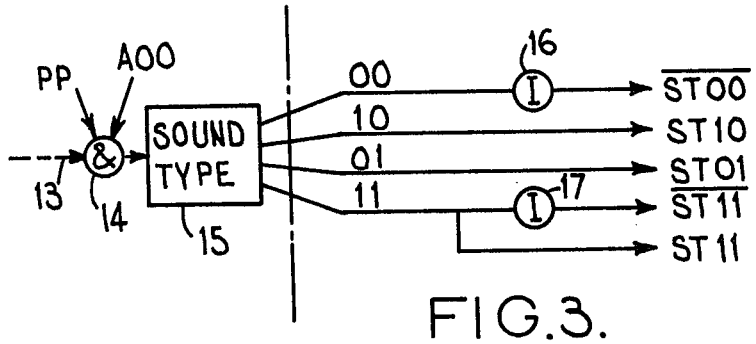
FIG. 3 illustrates the specification of a sound by input parameters.

Thus, dealing with the single channel under consideration, the parameter values are gated into the input parameter block 7 by a timing signal A00 at the beginning of a new pitch period, which is indicated, as will be explained, by a signal PP. A typical parameter is shown in FIG. 3. A input line 13 from the channel selector 6 (FIG. 1) is connected to an AND gate 14 (FIG. 3) which is opened by the signals A00 and PP to permit the digital representation of parameter "Sound Type" to pass into a two-bit register and decoding network 15. It will be seen that a two-bit expression may be decoded into one of four states, and the network 15 therefore decodes the expression to produce a signal on one of four lines ST00-ST11 These lines have a significance as follows:

ST00 carries a signal if the sound has only a voiced component,

ST01 carries a signal if the sound has an undamped unvoiced component together with a damped voiced component,

ST10 carries a signal if the sound has voiced and unvoiced components which are both damped, and

ST11 carries a signal if the sound has only an unvoiced component.

The signals ST00 and ST11 are, for convenience, both inverted by inverters 16 and 17 respectively so that the resultant signals $\overline{ST00}$ and $\overline{ST11}$ represent respectively a sound that has a fricative content and a sound that has a voiced content.

The remaining parameters held in the channel registers 5 (FIG. 1) are individually gated into their respective registers and gating networks of the block 7 in a similar manner. The values which these parameters represent, however, are closely associated with specific parts of the sound generation and combination arrangements of the blocks 1, 2 and 3 and it is convenient, for the purposes of the present explanation, to deal with them specifically in considering these blocks in detail in the following sections.

VOICED SOUND GENERATION

Figure 4:
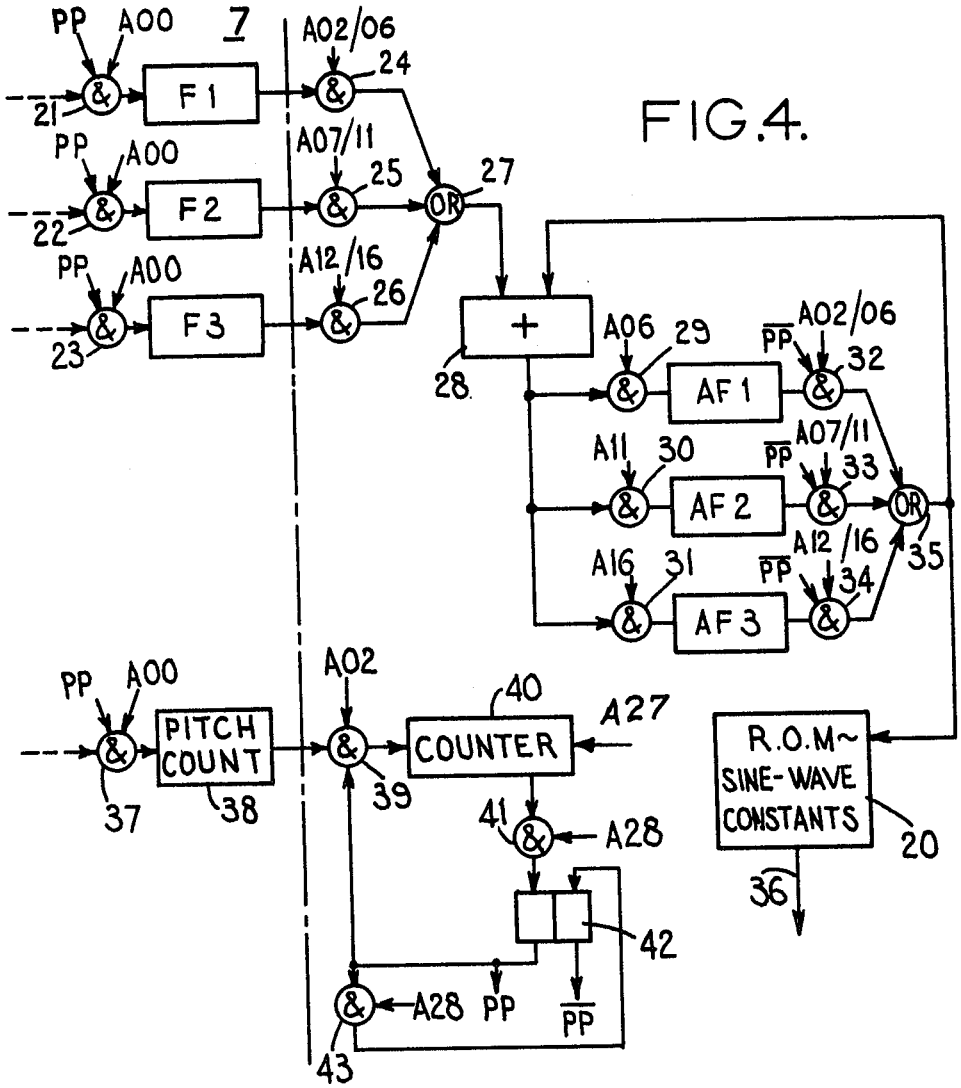
FIG. 4 shows diagrammatically an arrangement for the generation of a voiced sound.

The arrangement 1 for generating voiced sounds will now be considered in conjunction with FIG. 4. It is first convenient to consider the way in which a digitally expressed waveform resultng from the combination of three separate waveforms of differing frequencies may be derived from a single sinusoidal waveform expression.

It will readily be apparent that if a sinusoidal waveform is interrogated at constant intervals along its axis, a series of values repesenting the instantaneous amplitudes of the waveform at the interrogation points will result and that chosing the interrogation intervals sufficiently closely will result in a series of values that closely specifies the waveform shape. If, now, a selection of alternate ones of the values of this series is made and a resultant waveform plotted, using the same spatial intervals as was originally used in computing the series, then a new waveform of approximately sinusoidal form but having a repitition frequency twice that of the original waveform will result. The accuracy of the waveform shape will clearly depend upon the original interrogation interval increment. It will also be understood that if, in extracting values from the computed series, strings of values are obtained using different interrogation increments, and successive values of the two strings are summed, the resultant single string will specify a waveform which is the sum of two waveforms of different frequencies. This is the principle of operation of the present arrangement, the computed series of values specifying a single sine wave being stored in a read-only memory 20 (FIG. 4) in sequential storage locations. In practice, only a quarter sine wave need be represented, the location addresses then incorporating provision for inverting and/or negating the stored values to represent a full sine wave.

The frequencies of three formant waveforms which go to make up a voiced sound component are expressed as the interrogation intervals to be applied in interrogating the memory 20. These intervals are expressed digitally as address increments to be applied in selecting the sequence of storage locations in the memory 20.

These increments are specified as the parameters of the formant frequencies and like other parameters are gated by means of AND gates 21, 22 and 23 at the time A00 into formant increment registers F1, F2, and F3 respectively at the beginning of a new pitch period, as explained above. The registers F1, F2 and F3 are, of course, contained within the channel input parameters block 7 of FIG. 1. It is to be understood that values from one location to another within the apparatus are, in fact, clocked on transfer in conventional manner. However, for the sake of simplicity, clock lines are omitted from the drawings.

The registers F1, F2 and F3 are connected respectively to AND gates 24, 25 and 26 which are opened by signals at times A02/06, A07/11 and A12/16 respectively. Outputs from these AND gates are connected through an OR gate 27 as one input to an adder 28 which receives another input from an OR gate 35. The adder 28 output is connected in common to three AND gates 29, 30 and 31 which are opened by signals at times A06, A11 and A16 respectively. Outputs from the gates 29, 30 and 31 are applied respectively to formant address registers AF1, AF2 and AF3 and outputs from these registers are applied to a further group of three AND gates 32, 33 and 34 respectively. The gate 32 is opened by signal at time A02/06, the gate 33 by a signal at time A07/11 and the gate 34 by a signal at time 12/16. Outputs from the gates 32, 33 and 34 are connected is common to the OR gate 35 whose output is applied as an addressing input to the memory 20 as well as being recirculated as an input to the adder 28.

In response to the application of an address input to the memory 20, the contents of the addressed location are applied to an store output line 36 which is applied to the amplitude and damping arrangement 3 of FIG. 1, to be described in detail hereinafter. Associated with the generation of voiced sounds is a pitch control arrangement. The required pitch of a sound is specified as a pitch period parameter in terms of the number of 100μs periods for which the sound generation is to continue, the parameter therefor being termed the pitch count. It will be remembered that the 100μs period is common to both arrangements 2 and 3 (FIG. 1) so that using this period to specify the pitch parameter is convenient in ensuring the synchronisation of these arrangements. The required pitch period is specified together with the other parameters defining the sound to be generated and is present in common with those others in the block 5, to be gated by signal PP at the beginning of the pitch period which it represents through AND gate 37 at time A00 to a pitch-count register 38 within the block 7 of FIG. 1.

The register 38 (FIG. 4) is connected through an AND gate 39 to a counter 40. The counter 40 is decremented by unity on each operational cycle by a signal at time A27. The counter 40 includes an assembly of gates connected to its stages to produce an output when all the stages contain zero. This output is gated by an AND gate 41 at time A28 to control a bistable 42, the output being taken directly to set the bistable 42. The set output of the bistable is applied through an AND gate 43 at time A28 to reset the bistable 42 so that it is set only during the operational cycle following that in which the counter 40 registers all zero. This all zero condition represents the end of a pitch period and two signals are derived from the bistable 42. One of these is the signal PP, previously referred to and is produced by the setting of the bistable 42 to indicate that a new pitch period is about to be entered. The signal PP is also applied in conjunction with timing signal A02 to open the gate 39 to load the pitch counter 40 with the input parameter from the pitch count register 38 at the beginning of the new pitch period.

The second signal from the bistable, $\overline{PP}$ is continuously present except during the first operational cycle of a new pitch period and is applied to the gates 32, 33 and 34 controlling the outputs from the formant address registers AF1, AF2 and AF3 so that these are closed during the first operational cycle of the new pitch period.

The operation of the voiced sound generating arrangement will now be briefly reviewed. For simplicity, the operation of the arrangement during an intermediate operational cycle of a pitch period will first be dealt with. Under these circumstances an accumulated address will have been built up in the formant address registers AF1-3 during preceeding operational cycles. Then, during the current operating cycle the gates 32, 33 and 34 will be successively opened at times A02/06, A07/11 and A11/16 respectively, to allow the addresses registered in the registers AF1-3 to pass in sequence to the addressing inputs of the memory 20. As each address is supplied to the memory the contents of the addressed locations are made available on the input line 36. In particular, it will be seen that the address relating to the first formant sine wave component will be available from register AF1 from time A02, so that by time A05 the output from the memory is stabilised and, as will be later described, this output will already have been gated into the combining arrangement 3. Similarly the outputs respectively associated with the second and third formants will have been made available over the line 36 to the combining arrangement 3 by times A10 and A15 respectively.

Again dealing in particular with the first formant, it will be seen that during the time period A02/06, when the address from register AF1 is applied to the memory 20, the same information is fed back from the OR gate 35 to the adder 28. A further increment from the parameter register F1 is also applied to the adder 28 through the AND gate 24 with the result that an updated total is produced at the output of the adder 28, and this output is gated through the AND gate 29 into the address register AF1 at time A06. Thus, the new updated address for this formant waveform is not effective on this operational cycle since it is not available in the address register AF1 until after the time period A05 referred to in the preceding paragraph. Consideration of the arrangements for the remaining two formants will show that in each case the current address is available to be applied to address the memory 20 and that the address in each of the registers AF2 and AF3 respectively is updated by the addition of a further increment from the respective one of registers F2 and F3 in the same way as described for the first formant in readiness for the next cycle of operation, the updating in all cases taking place after the output value from the memory 20 has been gated into the amplitude and damping arrangement 3.

Finally, as noted earlier, in the first operational cycle of a new pitch period, as indicated by the setting of the bistable 42, the signal $\overline{PP}$ is removed from the gates 32, 33, and 34. Hence, in this operational cycle, the addresses from the registers AF1, AF2 and AF3 are inhibited from being applied to the memory 20, with the result that effectively the resultant zero address represents the start of a new formant waveform. Because the gates 32, 33 and 34 remain closed during this cycle, an effective total address of zero is returned to the adder 28 and the adder 28 then receives only the increments from the registers F1, F2 and F3. Hence, at times A06, A11 and A16 respectively, outputs from the adder 28 shifted into the registers AF1, AF2 and AF3 will equal only a single increment of address for each of the three formants. In this way a new pitch period always starts at zero.

It will be seen that, just as the addressing increment applied at regular sampling intervals will produce an output waveform having a frequency set by the magnitude of the increment, the sampling of the memory by three different addressing increments should produce three separate waveforms of differing frequencies, and it will be appreciated that the instantaneous values of magnitude for each increment of these waveforms respectively are interlaced, one for each of the three formant waveforms being produced in each operating cycle of 3.125μs.

UNVOICED OR FRICATIVE SOUND GENERATION

The generation of unvoiced sounds is based on the non-recursive filtering of a pseudo-random value sequence, the filtering taking the form of the conditional summing of a sequence of weights in dependence upon the succession of digits in the value sequence. The weights for this purpose are predetermined and eight weighting sequences are provided according to the unvoiced sound type that each is to produce and are stored in a read only memory. It is found that eight types of unvoiced sounds are sufficient for recognisable speech and values for each of these eight sounds are generated in turn, the successive values representing each sound being stored in a buffer which is updated on a cyclic basis, the required value for any prescribed one of the sounds being extracted from the buffer at a predetermined point in the operating cycle of the apparatus referred to earlier.

As noted earlier, the generation of an unvoiced sound does not fit conveniently into the operational cycle of 3.125μs previously described, and, subject to the requirement that each of the values in the buffer must be updated once in every 100μs, the atual generation of the values can take place independently of the rest of the apparatus, a value being extracted from the buffer as required for the operating cycle associated with each channel.

Figure 5:
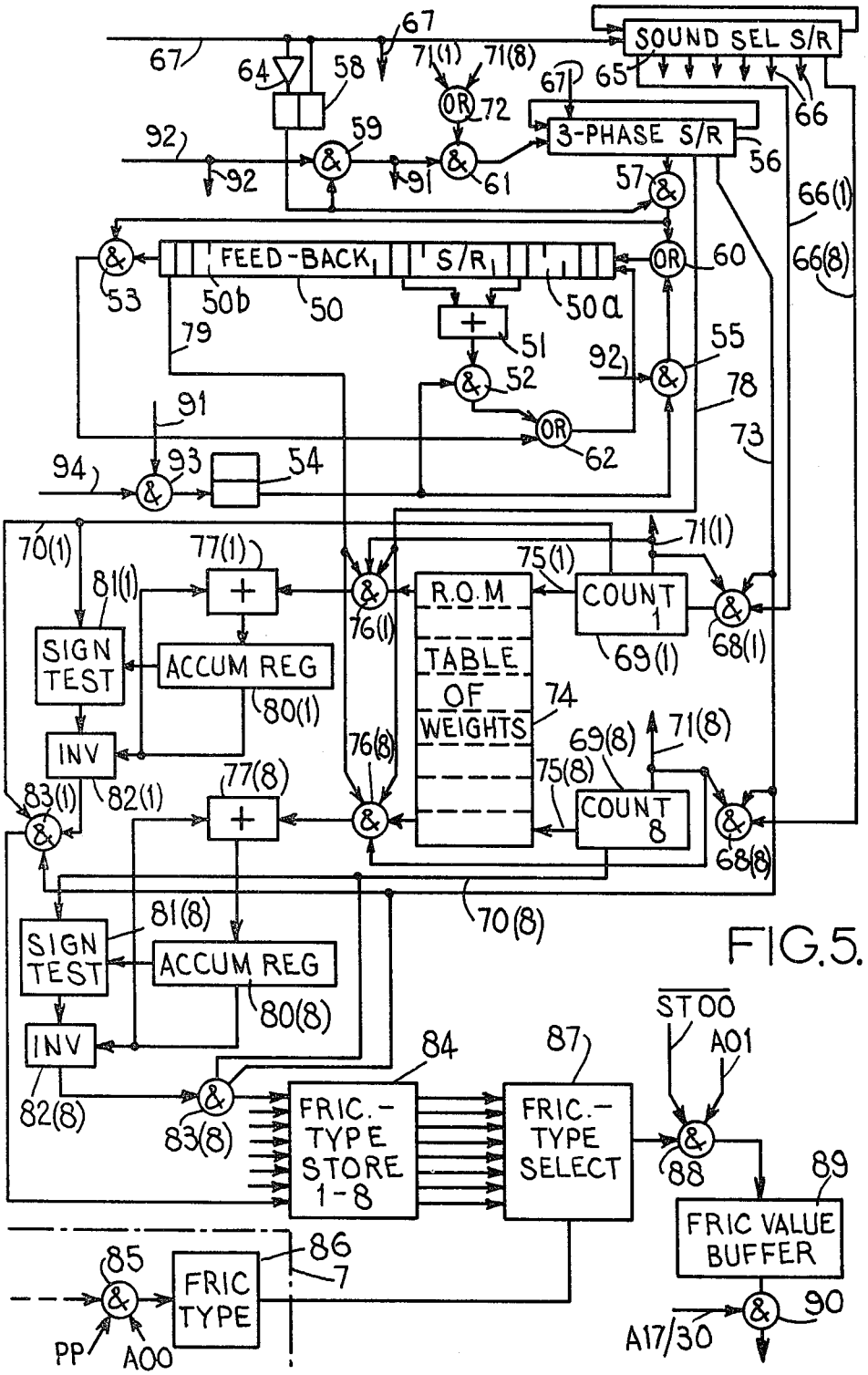
FIG. 5 shows diagrammatically an arrangement for the generation of an unvoiced sound, FIGS. 6*a* and 6*b* taken together with FIG. 6*b* placed below FIG. 6*a* form a composite FIG. 6 to illustrate an arrangement for the combination of voiced and unvoiced sounds.

The generation of unvoiced sounds will now be described in detail with reference to FIG. 5, in which a feedback shift register 50 is provided having 32 stages.

It is convenient to regard the shift register 50 as consisting of two parts, a first part 50*a* of 18 stages forming a feedback shift register by connection with an adder 51, the output from which is recirculated through the first part 50*a* of the register by means of a gate 52. The remainder of the register 50, part 50*b*, may then be regarded as an extension of the part 50*a* into which bits generated in part 50*a* are shifted. A gate 53 is provided to modify the recirculation path for the register 50 to include all thirty-two stages, the outputs from gates 52 and 53 being connected through an OR gate 62 in the recirculating path of the register 50.

The alternative recirculation paths of the register 50 are respectively associated with different shifting rates. For this purpose, the gate 52 is opened by a signal from a monostable 54 which also enables a futher AND gate 55 to permit a first clock pulse from line 92 to be connected through an OR gate 60 to the shift control input of the register. The line 92 carries clock pulses at the 97.67ns rate from the basic 10.24MHz source (not shown). The monostable 54 is set by a signal through an AND gate 93 by pulses at 100μs intervals on line 94, the gate 93 also being clocked by pulses on a line 91.

Clock pulses at a second rate are derived from a first stage of a three-stage recirculating shift register 56 and applied through an AND gate 57 to the OR gate 60. The gate 57 is opened by an output from a bistable 58 which also opens another AND gate 59 to permit pulses from the line 92 to pass towards the shift register 56 through a further AND gate 61. Hence, the gate 57 controls the shift input to the shift register 50 and also opens the gate 53. While the monostable 54 permits circulation of the feedback shift register 50 only around the part 50*a* once in each 100μs period, the bistable 58 controls the recirculation of the contents of the shift register 50 throughout its entire length, the recirculation being timed by the shift register 56. The shift register is reset by signals on the line 67.

The bistable 58 is connected to respond to timing signals at 12.5μs intervals. It will be recalled that eight unvoiced or fricative sound types are provided and that each is to be updated once in a 100μs cycle. Hence, the updating of each unvoiced or fricative sound type may take no longer than 12.5μs. Thus, the 12.5μs timing signals are applied over a line 67 to the bistable 58, directly to the resetting input and through a 300ns delay element 64 to the setting input. The same line 67 also serves as a master resetting output and is connected to a sound-type selection shift register 65, which has eight outputs 66 selected in order in response to successive signals on the line 67. Each of the outputs 66 is associated with a different one of the fricative sound types, which are all generated in a similar manner. Thus, the output 66(1), associated with the first sound type, is connected to condition an AND gate 68(1) while the output 66(8) is associated with the eigth sound type and is connected to a similar AND gate 68(8). The output of the AND gate 68(1) is connected to an input of a counter 69(1) which is arranged to count the signals delivered to its input. The counter 69(1) also contains a group of gates arranged to provide indicating signals on a pair of lines 70(1) and 71(1). The line 70(1) carries a signal when the counter 69(1) contains the value thirty-one and this indication is inverted to provide the signal on line 71(1) which is therefore energised while the count is other than this value. The line 71(1) is also connected to the AND gate 68(1) so that this gate is opened if the first fricative sound type is being updated and while the total registered by the associated counter 69(1) is less than 31 to permit output signals on a line 73 from the third stage of the shift register 56 to be counted. The signal on line 71(1) together with similar signals from the remaining counters 69 associated with the other fricative sound types is applied through OR gate 72 to maintain open the gate 61 to permit the shift register 56 to be cycled during the count period of any of the counters 69. The counters 69 are reset by signals on the line 67.

An output 75(1) from the counter 69(1) carries the value of the count and is applied as an addressing input to a read-only memory 74. It is convenient at this stage to consider the memory 74 as consisting of individual sections, each associated with a different one of the counters 69 and, hence, each arranged to store a table of weight values associated with a different one of the fricative sound types. The count output 75(1) therefore causes the weight values of the table associated with the first fricative sound type to be selected in order and presented in turn through AND gate 76(1) to an adder 77(1). The AND gate 76(1) is conditioned by an output on line 78 from the second stage of the shift register 56; by the signal on line 71(1) and by an output on line 79 from the final stage of the shift register 50. An output from the adder 77(1) is applied to an accumulator register 80(1) the output of which provides a second input to the adder 77(1). The accumulator register 80(1) also provides an output to a sign testing gating network 81(1) which is responsive to the highest denomination of the value registration in the register 80(1) to control an inversion and sign generation newtwork 82(1). The network 82(1) accepts the output from the accumulator register 80(1) and passes it through an AND gate 83(1) to a fricative value store 84.

The sign testing network is conditioned by a signal on the line 70(1) and the gate 83(1) is conditioned by signals on the lines 70(1) and 73 so that it is effective only when the count in counter 69(1) registers thirty-one to permit the value from the accumulator register 80(1) to pass in corrected form to the store 84. The store 84 is an eight-position store which will accept a value from each of the accumulator registers 80 associated respectively with each different fricative sound type and store this value in that position associated with the respective sound type.

The particular one of the eight fricative sound types required for the synthesis of a sound is specified as a three-bit binary code expression as one of the parameters for that sound and is gated by AND gate 85 into a fricativetype register 86, within the block 7 of FIG. 1, at the same time in an operational cycle, A00, as the remaining parameters are gated into their respective registers at the beginning of a pitch period. The output from the register 86 is expressed in the same binary code notation and specifies the particular sound type to be sampled. The output is supplied to an address decoding network 87 to select the appropriate value from the store 84. This value is gated by an AND gate 88 opened at time A01 and further conditioned by the $\overline{\text{ST00}}$ signal so that the gate 86 is opened only in those operational cycles in which the sound to be synthesised is specified as including a fricative content. The value from the gate 88 passes into a fricative value buffer 89 where it is available for use as required during the remainder of the operational cycle, and from where it is gated by means of AND gate 90 at time A17/30 into the amplitude and damping arrangement 3 (FIG. 1), to be described later.

The operational of the fricative sound generating arrangement will now be described. For simplicity the generation of a succession of values in random order will be first considered. The generation of such a succession is known in the art and consists of the provision of a fixed length shift register, in this case the register portion 50*a*, with recirculation from its last stage through an adder whose other input is taken from an intermediate stage. The binary digit entered into the first stage of the register is the single denominational sum digit of the digits of the pair of stages from which the adder inputs are taken. The use of mathematical tables enables an intermediate stage of the feedback shift register thus formed to be specified in order to generate a train of values in pseudorandom order and which will not repeat in a succession of cycles less than the capacity of the shift register.

This operation of pseudo-random value selection is performed under control of the monostable 54, which is set by one of the pulses at 100μs intervals on line 94 through the gate 93. It will be recalled that the line 92 provides clock pulses at a intervals of 97.67ns (which can be regarded for convenience as approximately 100 ns intervals). These pulses are actually inverted as they are applied to the AND gate 59 so that clock pulses at the same frequency but of opposite phase are available on line 91 at the output of this AND gate 59. For convenience these pulses will be referred to as "inverted clock". The gate 93 is fed by these inverted clock pulses on line 91 and the monostable 54 is arranged to respond to one edge of a pulse so that the monostable 54 will change its state in the inter-pulse period of the 100ns clock. Since this monostable has a delay time of 100ns, it will be clear that it will remain set sufficiently long to cover a single one of the 100ns clock pulses. Hence, the gate 55, which is controlled by the set output of monostable 54, will permit a single clock pulse to pass to produce a single shift operation of the register 50. The adder 51 will already at this point have produced an output and the gate 52, which is opened by the setting of the monostable 54 allows this output to pass the OR gate 62 to enter the first state of the shift register 50 as shifting takes place. The shifting operation applies to the whole register 50 as that the final value from the portion 50*a* passes into the portion 50*b*. The final value from the portion 50*b* however is lost as it is shifted out, because the gate 53 is not open at this time. The effect of these initial actions is that the feedback shift register 50 is shifted to produce a new value once in every 100μs cycle, and the monostable 54 then restores, thus inhibiting the production of another new value until the occurence of another of the pulses at 100μs intervals on the line 94.

The generating arrangement then performs eight updating cycles, one for each of the fricative sound types. Since all these cycles are similar, only the first will be described in detail. The updating is initiated once each 12.5μs by signals on the line 67. An initiating signal passes directly to the sound selection shift register 65, in which only one stage is set to produce an output on only one of the lines 66. In the present example, it is assumed that the signal on line 67 steps the register 65 to select the counter 69(1) associated with the first fricative sound type. At the same time, the signal on line 67 unsets the bistable 58 and resets the counter 69(1), the accumulator register 80(1) and shift register 56 in readiness for a new count and is also applied to the delay element 64.

After 300ns, the delay period of the element 64 which allows the components to settle after resetting and selection (and also is sufficiently long to permit the generation of a new value under control of the monostable 54 once in an operational cycle as described above), the bistable 58 is again set. Setting of the bistable 58 causes the train of 97.67ns clock pulses to be applied to the shift register 56 to start a continuous sequence of three steps or phases as the shift register 56 is repeatedly recycled. On the first phase, the gate 57 is opened to allow a shift pulse to be applied to the shift register 50 and also to open the gate 53 to recirculate the digit read out of the last stage of the register 50 back to the beginning.

On the second phase of the shift register 56 sequence, gate 76(1) is conditioned to open by the output on line 78 from the second stage of the register 56. The gate 76(1) is also conditioned by signals on the line 71(1) and because the counter 69(1) has just been reset to zero, and therefore does not hold the value thirty-one, a conditioning signal will be present at this time on this line. Finally, the gate 76(1) is conditioned by the binary value contained in the final stage of the shift register 50. At this point in the process the count is zero, so the weight table store 74 will be addressed by the application of this value to the first section of storage and the value contained at this address will be available at the gate 76(1). The arrangement is such that if the value in the final stage of shift register 50 is a binary one the gate 76(1) remains closed, whereas if this value is a binary zero the gate 76(1) is opened by the second phase signal to permit the stored value from the weight table store 74 to pass to adder 77(1). Assuming the value to be passed by the gate 76(1) then, because the accumulator register 80(1) was reset at the beginning of the updating period, there is no other input to the adder 77(1) and the value passes unchanged into the accumulator register 80(1).

The third phase of the shift register 56 applies an increment to the count input of the counter 69(1) in readiness for the first phase of the next shift register cycle. The output from the third stage of the shift register 56 is applied to gates 68(1–8). The gate 68(1) is selected by the sound-selection shift register 65 and since the current count is zero the signal on line 71(1) is present to permit the gate 68(1) to open and allow the count increment signal to pass to step the counter 69(1) to the value one.

The above three phases are repeated as the count is incremented until the counter 69(1) contains the value 31, which occurs at the third phase of the 31 cycle of the shift register 56. During the preceding cycles the count has progressively increased to address the storage locations of the first part of the store 74 in turn and, in accordance with the digits presented successively at the first stage of the shift register 50, the weights read out from the store 74 are either added or not into the accumulator register 80(1) to form a new value for the first of the fricative sound types. On the next step of the shift register 56, to its first phase, the 32 shift movement of the register 50 takes place, which brings the digits in this register back into the positions they occupied at the beginning of the updating cycle. On the second phase of this cycle of register 56 the signal line 71(1) is not present because the value in the counter 69(1) is now 31. Hence, the gate 76(1) inhibits the passage of a value from the weight-table store 74. Similarly, on the third phase of the cycle, the gate 68(1) is inhibited by the absence of the signal on the line 71(1) and the progression of the count comes to an end, although the counter 69(1) will continue to register the value 31 until it is reset at the beginning of the next sound-type updating operation.

During this time, however, there is a signal present on the line 70(1) and this signal is applied to initiate the writing away of the new value just calculated. The signal on line 70(1) is first applied to the sign test indicator 81(1) which tests the most significant digit position of the accumulator register 80(1). If the value is negative, the indicator 81(1) produces an output to set a group of inverter gates 82(1) which complement and add unity to the value held in the register 80(1). If the value is positive these gates are unset and the value passes unchanged through the inverter 82(1). The presence of the signal on the line 70(1) permits the gate 83(1) to open on the third phase of the cycle to pass the value, together with a sign-indicating bit, in true form to the fricative value store 84, the value being stored in one of eight locations provided, each associated with a different one of the fricative sound types.

On receipt of the next initiating signal from the OR gate 62, the entire updating cycle is repeated, the signal on line 67 stepping the sound-type selection register 65 to select the next fricative sound-type for updating. In this way all eight fricative sound-type values are updated once in every one of the 100μs sampling period cycles, so that whatever fricative sound-type is specified as a parameter of the sound to be generated, that sound value will be updated between sampling periods in successive cycles. The actual fricative sound-type parameter is applied to the fricative sound-type register 86, the output from which selects the appropriate value to be extracted from the store 84 by the selector 87. This value is then applied through AND gate 88 at the beginning of a sampling period cycle into the buffer 89 in readiness for transmission through the gate 90 later in the cycle. For the sake of simplicity the store 74 for the weight tables is described as having separate sections. In practice, however, the store 74 may actually be a single store with a single sequence of storage locations. In this case the addressing arrangements are organised to permit the store 74 to be used for the selection of the appropriate locations for each individual weight table. Thus, the 32 locations of a single table are selected by the five least significant binary denominations of the address and a single counter with an eight-denomination capacity may be used as the counter 69. The selection of the next store section is then performed by adding unity in to the sixth denomination from the least significant end of the counter instead of stepping a separate selection register, such as the register 65. In fact the addition of unity may also be achieved by allowing a carryover from the fifth denomination which will occur if a count of 31 is reset by forcing a long carry.

COMBINATION OF VOICED AND UNVOICED SOUNDS

(AMPLITUDE AND DAMPING)

Figure 6A:
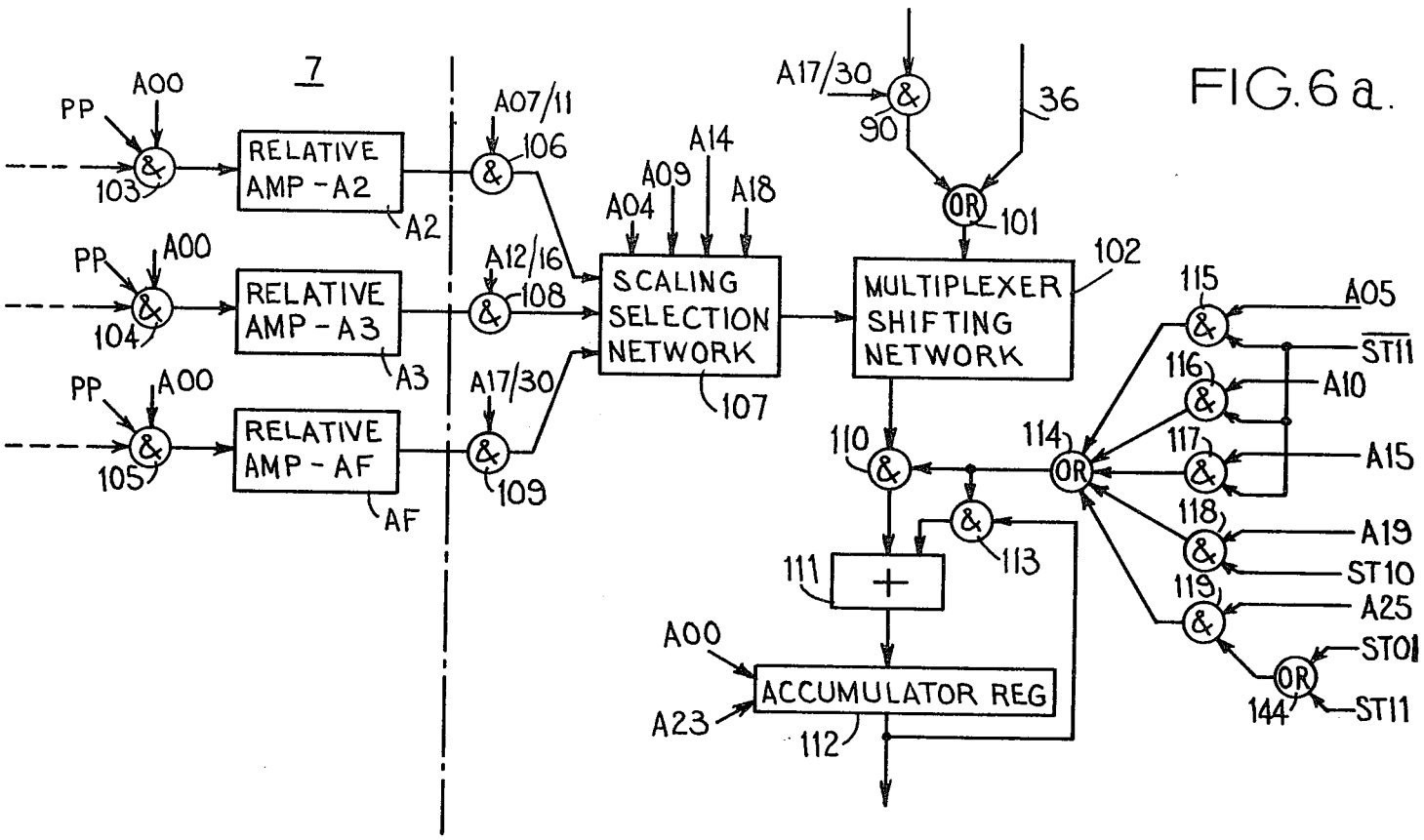
Figure 6B:
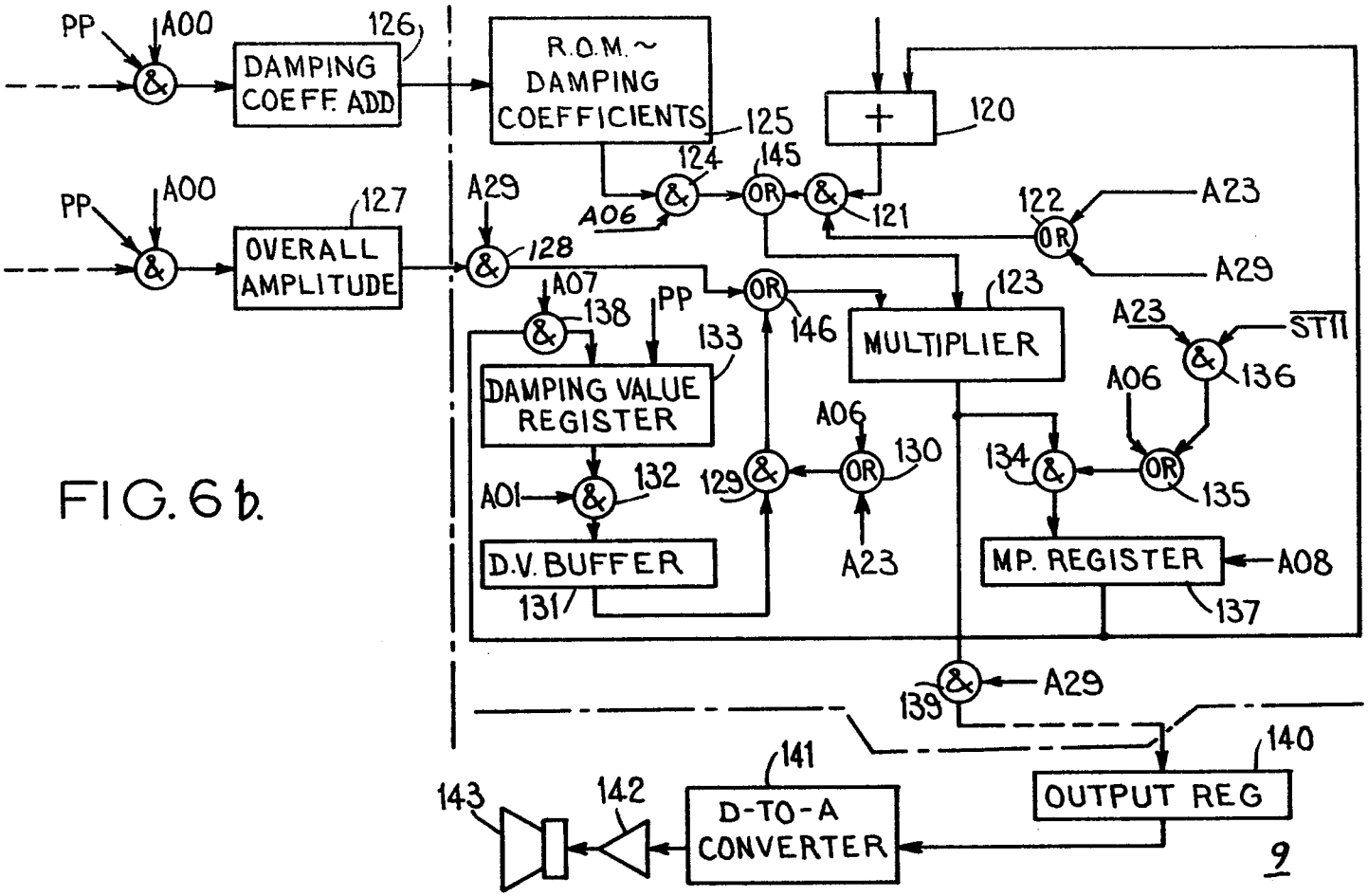

The foregoing sections have dealt with the generation of instantaneous values for voiced and unvoiced sounds and the transmission of these values to the line 36 and gate 90 respectively. FIG. 6, which is a composite drawing made up by taking together FIGS. 6*a* and 6*b* with FIG. 6*b* placed below FIG. 6*a*, shows in detail the arrangements for combining these values and controlling the relative amplitudes for the component parts of the combined sound together with the superimposition of damping to the resultand sound value.

Referring now to FIG. 6, the line 36 and the gate 90 are connected to an OR gate 101 whose output is connected to a multiplexer scaling shifting network 102. The network 102 is controlled by amplitude parameters which are part of the specification of the required sound. Rather than an attempt to specify absolute amplitude, the present arrangement requires that the amplitudes of the component parts of the sound are specified relative to the amplitude of the principle format, which is made the first formant. In order to retain the simplicity of the digital value specification, the convention is observed that the relative amplitudes are expressed in terms of a 6db attenuation of the component concerned as compared with the principle formant. These values are entered in the same way as other parameters into parameter registers within the block 7 of FIG. 1. Thus, in FIG. 6, the relative amplitude of the second formant is entered at the beginning of a new pitch period at time A00 through gate 103 into register A2, that of the third formant through gate 104 into register A3 and that of the fricative component through gate 105 into register AF. The value from register A2 is gated by AND gate 106 at time A07/11 into a scaling selection network 107. The value from register A3 passes into the same network 107 through AND gate 108 at time A12/16 and AND gate 109 passes the value from register AF into the network 107 at time A17/30. The network 107 is arranged to receive binary value signals from the registers A2, A3 and AF and to decode these signals to provide outputs to control a group of eight multiplexers within the network 102. The multiplexers are arranged to provide a relative columnar shift between their inputs and outputs. Of these multiplexers, seven provide differing degrees of right shift while the eigth provides a "no-shift" condition so that by selection of the appropriate multiplexers any degree of shift from zero to seven places is provided, the selection being performed by the decoded signals from the network 107 in accordance with the values from the registers A2, A3 and AF. The selection of the multiplexers from these decoded signals is conditioned by timing signals A09, A14 and A18 respectively and an additional timing signal A04 is also provided which always selects the "no-shift" multiplexer to permit the first formant value to pass unchanged through the network 102.

The outputs of the network 102 are gated through an AND gate 110 to one input of an adder 111, whose output feeds an accumulator register 112, the output of the accumulator register 112 being circulated through an AND gate 113 to the second input to the adder. The gates 110 and 113 are controlled by the output of an OR gate 114 which receives the outputs of five timing AND gates 115 and 119 respectively.

The gate 115 is controlled by coincidence of signals A05 and $\overline{ST11}$ so that this gate is opened at time A05 if the sound required has a voiced content. The gate 116 is opened at time A10 if a voiced content is specified and the gate 117 is opened at time A15, again if a voiced content is required. The gate 118 is opened at time A19 if signal ST10 is also present, indicating that a damped unvoiced or fricative component is required and, finally, the gate 119 is opened at time A25 if signals ST01 or ST11 are present to indicate the requirements for an undamped unvoiced or fricative component, these two signals being applied to gate 119 through an OR gate 144.

From the register 112, which is reset at times A23, and A00, an output is connected to one input of an adder 120. The output of the adder 120 is connected to an AND gate 121 which is controlled to be opened at times A23 and A29 by signals applied through an OR gate 122. The output of the gate 121 is connected through an OR gate 145 to one input of a multiplier 123. The OR gate 145 at the input of the multiplier 123 is also served by an AND gate 124 opened at time A06 to connect the output of a damping coefficient store 125. The store 125 is a read only memory and contains within its storage locations damping coefficients which will provide the appropriate damping rate specified for the sound to be synthesized. The actual coefficient selected is obtained by addressing the store 125 with a damping coefficient parameter derived from a damping coefficient register 126 in the block 7 of FIG. 1, the register 126 (FIG. 6) having the parameter gated into it, as in the case of other parameters, at the beginning of a new pitch period at time A00.

A further parameter is also gated in this way into an overall amplitude register 127 which specifies the effective amplitude required for the sound. The contents of the register 127 are gated through an AND gate 128 at time A29 into a second input of the multiplier 123 through an OR gate 146. This second input is also connected through the gate 146 and an AND gate 129, opened by signals through an OR gate 130 at times A06 and A23, to the output of a damping value buffer 131. The damping value buffer 131 receives an output from a damping value register 133 through an AND gate 132 opened at time A01. The damping value register 133 is used to hold the next required damping value as will be explained and is preset by signal PP from bistable 42 (FIG. 4).

The multiplier 123 (FIG. 6) provides an output which is applied to two paths. The first path includes an AND gate 134 which is opened under control of an OR gate 135, the OR gate 135 passing a signal at time A06 unconditionally, or passing another signal from an AND gate 136 opened at time A23 in the presence of the signal $\overline{ST11}$ if a voiced component is specified. The AND gate 134 enables the output of the multiplier 123 to be applied to a multiplier register 137 which is reset at time A08 and which provides a second input to the adder 120 and also, through an AND gate 138 open at the A07, provides an input to the damping value register 133.

The second output path from the multiplier 123 is connected to an AND gate 139 opened at time A29 which provides the output from the sound generating arrangements. The output from the gate is taken through the channel selecting arrangements 6 (FIG. 1) and is applied, as indicated in FIG. 6, to the sound conversion arrangement of the channel to which the sound generator is coupled. This conversion arrangement includes an output register 140 to receive the output value from the gate 139. A digital-to-analogue converter 141 is connected to the register 140 and the output of the converter 141 is connected through a low pass filter 142 to a sound output transducer 143, such as an amplifier-loudspeaker combination. The operations carried out in combining the values representing voiced and unvoiced components by the amplitude and damping arrangements will now be considered in detail. It will first be assumed that a sound having both voiced and unvoiced components is specified.

It will be recalled that the instantaneous values of the three formant waveforms are presented on the line 36 (FIGS. 4 and 6) during the first or "voiced" part of the operational cycle during the time period A00/16. The value for the first formant is available during the period A02/06. This value is therefore passed during this period into the multiplexer shifting network 102 which, as explained, is conditioned by timing signal A04 applied to the scaling selection network 107 to permit the value to pass unchanged through gate 110 (opened at time A05) into the adder 111. Because the accumulator register was reset at A00 in the current operational cycle, there is currently no feedback from the register 112 to the gate 113 so that there is no other input to the adder 111 at this time. Once registered the value from the accumulator register 112 is fed back to gate 113.

The value for the second formant is available on the line 36 during the time period A07/11 and it is duly entered into the multiplexer shifting network 102 at this time. It will be remembered that the relative amplitude of the second formant is expressed in increments of −6db and that a multiplexer in the network 102 is selected to provide a shift of as many places as are represented by the value in the relative amplitude register A2. This selection is performed at time period A09 by the scaling selection the network 107 to shift the value passing through the network 102 by the appropriate number of places to the right, each place halving the value registered. The shifted value is then passed, at time A10 as determined by AND gate 116, to the adder where it is summed with the first formant value, and the total is again recirculated to the gate 113 for further combination.

In a similar way the value for the third formant is available through and gate 36 and passed to the network 102 during the time period A12/16. The relative amplitude parameter applicable to the second formant is decoded by network 107 at time A14 to select the appropriate multiplexer within network 102 to apply the required right shift in time for the shifted value to pass to adder 111 when gate 110 is opened by the gate 117 at time A15. This is the end of the "voiced sound" period of the operational cycle and this time the accumulator 112 contains the sum of three instantaneous sine-wave amplitude values, the three sine waves being of different frequencies (corresponding to the three formant frequencies) and two of them being corrected for amplitude relative to the first, which is always chosen to have greatest amplitude. It will be realised that if a sound has no voiced component, then the gate 110 is not opened and no "voiced-sound" components pass to the combining arrangement.

During the remainder of the operational cycle the fricative value appropriate to the sound specified is sampled and combined. However, in preparation for this combination certain other operations are carried out during the earlier "voiced-sound" period of the cycle. The reason for this overlapping is merely to economise in apparatus, to keep the operational cycle as short as possible, and to utulise the multiplier 123 for the preparation of the next-to-be required damping value during a period when this multiplier would otherwise not be in use.

Thus, at time A01 the current damping value, which, as will become apparent, is stored in the damping value register 133, is passed by gate 132 into the damping value buffer 131. Then, at time A06, gates 129 and 124 are opened to allow the values from the damping value buffer 131 and from that storage location of the damping coefficient store 125 specified by the damping coefficient parameter of the register 126, to pass respectively to the inputs of the multiplier 123. The resultant product is the damping value required for the next operational cycle and this value is gated out of the multiplier through gate 134 (opened at this time by gate 135) into the multiplier register 137. Finally, at time A07 the new damping value is read from the multiplier register 137 into the damping value register 133 through gate 138 and at a time A08 the multiplier register 137 is reset to zero. This leaves the current damping value in the buffer 131 with the next required value in the register 133. Because the damping value register is thus actually required to form a multiplier during the first operational cycle of a new pitch period, it will be appreciated that it is forced to unity in preparation for this cycle by the signal PP at the start of a new pitch period.

The first operation during the second part of the operation cycle is the extraction of the value of any fricative or unvoiced sound component from the fricative value buffer 89 (FIG. 5), the value passing through the AND gate 90 and the OR gate 101 (FIG. 6) to the multiplexer shifting network 102. The value is then shifted in the network 102 according to the relative amplitude specified by the value in register AF as decoded by the scaling selection network 107 at time A18.

The passage of the shifted value from the network 102 then depends upon whether the synthesised sound specification requires a damped or undamped fricative component. If, for example, a damped fricative, sound type ST10, is required, then gate 118 is opened by signal ST10 at time A19 to open gates 110 and 113 at this time. This permits the fricative value to be added to the sum of the three sine-wave values, the new sum being registered by accumulator register 112 and passed to one input of adder 120. The second input to adder 120 being zero because the multiplier register 137 has been reset, the sum passes unchanged to the output of the adder 120.

A second multiplication is now performed. The damping value from buffer 131 passes through gates 129 (opened at time A23 by gate 130) to one input of the multiplier 123. The output of the adder 120 is passed by gate 121, also opened at time A23, to the second input of the multiplier 123. The product of this multiplication is passed through gate 134 to the multiplier register 137, the gate 134 also being opened at time A23 by the gates 136 and 135. This product is also applied to one input of the adder 120. At this point it will be realised that the adder 120 has an input representing the damped sum of three voiced sine waves and a fricative value. In this case no other input should be applied to the adder 120 because the fricative value has already been sampled. The accumulator register 112 is therefore reset by a signal applied at time A23 so that it is cleared when the product is registered in the multiplier register 137.

A final multiplication is performed at time A29 to obtain a final value corrected by reference to the specified overall amplitude. The gates 128 and 121 are opened at this time (the latter being opened by the timing signal through OR gate 122) to allow the overall amplitude parameter from register 127 and the product of the previous multiplication now at the output of adder 120 respectively to be applied to the inputs of the multiplier. This final output of the multiplier passes out through the gate 139 to the channel selection arrangements within the block 6 of FIG. 1, which selects a channel output line 8 appropriate to the channel currently being serviced to receive this final output and pass it to the sound conversion unit 9 of the selected channel. The unit 9 contains an output register, a converter and filter arrangements as indicated in FIG. 6*b*. Thus, the final output from gate 139 passes to the output register 140 (FIG. 6) of the selected channel. Since the channels are scanned in continuous cyclic succession, it will be realised that an updating value, such as that derived as described above, will be available on a regular cyclic basis. This succession of instantaneous values is registered in the output register 140 and is converted into an analogue current form by the converter 141. The output of the converter 141 is then smoothed by low pass filter 142 before being applied to the reproducing transducer 143.

The immediately preceding paragraphs describe the production of a sound having damped voice and damped fricative components, corresponding to a sound of type ST10. It will be recalled that another sound type, ST01, requires that the fricative value shall be added into the final value after the voiced component has been damped. In this case, the sum of the three formant sine wave values is formed as before. The gate 118, however, is not opened at the time A19 in the absence of the ST10 signal so that the fricative value is not passed from the network 102 into the adder 111 at this time. Hence, when, at time A23 the multiplication of the sum value by the damping value takes place, the sum does not include the fricative component. Instead, the fricative component from the register 102 is gated into the adder 111 through gate 110 at time A25, the gate 119 being opened at this time by coincidence of signals A25 and ST01. At this time too, the product representing the damped sum has been registered in register 137 and is presented at one input of adder 120. The second input to the adder comes from the register 112 which was cleared, it will be remembered, at time A23 and which now receives the output of adder 111. This output is, in fact, the fricative value applied through gate 110 only, the second input to adder 111 being zero following the clearance of the register 112. Hence, the adder 120 forms the sum of the damped component value and the fricative value in undamped form as the input for the final amplitude multiplying operation at time A29 as described earlier.

The manner in which the remaining sound types is dealt with may be briefly mentioned. Sound type ST11, which is a fricative sound with no voiced component is produced by inhibiting the voiced component gates 115, 116 and 117 by the absence of the ST11 signal. Hence, considering the second multiplication step, it will be seen that since no values have been passed to the accumulator register 112 by time A23, one input of the multiplier receives the value zero so that the output and consequently the value applied to one input of adder 120 is also zero. The fricative value is passed through gate 110 at time A25 as determined by gates 114, 119 and 144 and passes unchanged through the adder 111, the register 112 and the adder 120 ready for the final multiplication at time A29.

The remaining sound, type ST00, has only a voiced component. Hence, the sum of the three sine values is formed by gating them into the adder 111 and accumulator register 112 during the "voiced-sound" period of the operational cycle. No fricative component value is gated into the adder 111 so that the second multiplication produces the damped sum value, there is no added component and the third multiplication forms the product of this damped value and the amplitude parameter.

The foregoing description deals with a single operational cycle which is completed in 3.125μs. The channels are each associated with a data processing apparatus which produces parameters representative of sounds to be generated on the associated channel. The channels are continuously polled in conventional manner. Thus, the channel selection arrangements of FIG. 1 are stepped on the completion of each operational cycle, that is at every 3.125μs. If the newly selected channel has already required the generation of a sound, then the parameter registers will contain the appropriate values and a flag will be set. Under these conditions an operational cycle will be effective as described to generate a new sample value for the continued generation of the sound specified. If the channel polled has not already required a sound to be generated, then either no sound is required, in which case an idle cycle will be performed, or it is about to request sound generation, and in this case the interface between the processing apparatus and the sound generating arrangements provides, in a well known and conventional manner, for the entry of the new parameters into the block 5 of FIG. 1 and for their subsequent transfer as at the beginning of a pitch period and at the appropriate time in an operational cycle into the block 7 as described. Once the parameters are held in the channel registers, the flag indicator will be set and the succession of sound generation operational cycles will proceed, one cycle each time the channel is polled by the selection means. The same selection device also controls the sound output by connecting the output of the gate 139 (FIG. 6) to the output channel register 140 which is associated with the processor from which the sound generation request came.

Some eight channels have successively been served by the multiplexing arrangements described. Working on the basis of the 100μs sampling period, then, it is seen to be possible to serve thirty-two channels, distributed, for example by a thirty-two stage shift register. Thus, each channel is connected for 3.125μs to receive the output of an operational cycle once in every 32 cycles, which in turn means that the output waveform for each channel is subject to updating at 0.1ms intervals. Sound requirements for recognisable speech change relatively infrequently — say of the order of one sound change in 10ms and a typical speech pattern requires some sixty- to one-hundred parameter sets to be dealt with in a second. The sampling of these parameters at this rate produces, after filtering, an audio output that appears to the human listener to be sufficiently continuous to form continuous speech.

We claim:

1. Speech synthesizing apparatus comprising means for generating a digital value representing an instantaneous amplitude of a voiced sound component during a sampling period; means for generating a digital value representing an instantaneous amplitude for each of a plurality of unvoiced sound components respectively in succession during a period greater than the duration of said sampling period; means for storing the values for the unvoiced sound components; means for registering parameters specifying characteristics of a sound to be reproduced; means responsive to the registering means for extracting from the store a selected one of the stored values; means for selectively combining, during the sampling period, voiced and unvoiced component values according to registered parameters; and timing means for synchronising the unvoiced sound generator with a succession of sampling periods to ensure that any one of the unvoiced sound values in said storing means is updated in the interval between sampling periods of the succession.

2. Apparatus as claimed in claim 1, having a plurality of speech synthesizing channels including means for scanning the channels cyclically, the scan for each channel occupying a single sampling period, the voiced sound component generating means being arranged to generate a value for each of the channels in succession during successive sampling periods in which the unvoiced sound component values are generated in succession during the period occupied by a complete scan of all the channels and in which the parameters for a sound required on each channel are respectively registered separately.

3. Apparatus as claimed in claim 2 in which the combining means includes summing means for forming the sum of the sound component values and modifying means for multiplying an applied value by a predetermined factor specified by a registered parameter.

4. Apparatus as claimed in claim 3 in which the combining means is responsive to registered parameters to vary the order of application of values to the modifying means to provide, selectively, modification of the sum of voiced and unvoiced component values and modification of only one of said values before the modified value is summed with the other of said values.

5. Apparatus as claimed in claim 3 having an output register, in which the modifying means includes a multiplying network and the combining means further includes a plurality of gates interconnecting the summing means and the multiplying network, the gates being controlled in response to timing signals from the timing means and to registered parameters for applying sound component values to the summing means at different times respectively and to pass resultant sum values from the multiplying network selectively back to the summing means and to the output register.

6. Apparatus as claimed in claim 5 in which the unvoiced sound component value generating means includes a recursive pseudo-random value generator arranged to control the accumulation of values from a predetermined sequence for each component and means for storing the resultant value of the accumulation.

* * * * *